US006026727A

United States Patent [19]

Meeks

[11] Patent Number: 6,026,727

[45] Date of Patent: Feb. 22, 2000

[54] ROTARY SCORING APPARATUS HAVING RETRACTABLE SCORING BLADE

[75] Inventor: William R. Meeks, LeCompton, Kans.

[73] Assignee: Lawrence Paper Company, Lawrence, Kans.

[21] Appl. No.: 08/796,224

[22] Filed: Feb. 6, 1997

Related U.S. Application Data

[60] Provisional application No. 60/033,754, Mar. 7, 1996.

[51] Int. Cl.[7] ..... B26D 3/08

[52] U.S. Cl. ..... 83/887; 83/884; 83/285; 83/305; 83/338; 83/346; 83/356.3; 83/508.1; 83/564; 83/585; 83/590; 83/630; 83/698.51

[58] Field of Search ..... 493/60, 61, 355, 493/396, 404; 83/886, 881, 884, 882, 863, 864, 698.4, 698.41, 698.61, 528, 530, 305, 296, 297, 285, 333, 338, 346, 355, 356.3, 508.1, 564, 568, 590, 584, 585, 592, 630, 667, 698.51

[56] References Cited

U.S. PATENT DOCUMENTS

| | | | |
|---|---|---|---|
| 1,129,481 | 2/1915 | Gores | 493/354 |
| 1,373,668 | 4/1921 | Pearsall | 493/355 |
| 1,525,238 | 2/1925 | Hurd | 493/355 |
| 1,567,656 | 12/1925 | Langston | 493/355 |
| 1,764,358 | 6/1930 | Smith | 493/60 |
| 1,786,726 | 12/1930 | Absmeier | 83/864 X |
| 1,802,554 | 4/1931 | Hahn | 83/337 |
| 1,832,481 | 11/1931 | Gebhart | 493/60 |
| 1,850,801 | 3/1932 | Langston et al. | 101/248 |
| 1,858,502 | 3/1932 | Langston et al. | 101/248 |
| 1,959,424 | 5/1934 | Hawkins et al. | 493/353 |
| 1,965,523 | 7/1934 | MacFarren | 83/305 |
| 1,977,812 | 10/1934 | Swift, Jr. | 493/321 |
| 2,117,220 | 5/1938 | Sieg | 495/354 |
| 2,120,920 | 6/1938 | Masters et al. | 493/364 |
| 2,121,105 | 6/1938 | Shields | 74/395 |
| 2,181,197 | 11/1939 | Moritz | 83/673 |
| 2,191,988 | 2/1940 | Greenwood | 493/321 |
| 2,259,441 | 1/1941 | Fitchett | 101/247 |
| 2,422,783 | 6/1947 | Jacobson | 271/136 |
| 2,491,871 | 12/1949 | Morgan | 83/305 |
| 2,662,452 | 12/1953 | Sidebotham | 493/54 |
| 2,672,452 | 4/1954 | Rockstrom | 101/247 |
| 2,701,613 | 2/1955 | Bishop | 83/332 |
| 2,706,944 | 4/1955 | Claff et al. | 101/227 |
| 2,946,380 | 7/1960 | Scribner | 234/50 |
| 2,982,189 | 5/1961 | Shields | 493/30 |
| 3,003,403 | 10/1961 | Goettsch | 493/365 |
| 3,008,366 | 11/1961 | Taylor, Jr. | 83/346 |
| 3,031,937 | 5/1962 | Greenwood et al. | 493/354 |
| 3,093,037 | 6/1963 | Ward, Jr. | 493/365 |
| 3,257,882 | 6/1966 | Lulie et al. | 83/864 |
| 3,325,335 | 6/1967 | Martensson | 156/498 |
| 3,386,323 | 6/1968 | Dovey | 83/440.1 |
| 3,443,490 | 5/1969 | Bishop | 493/365 |
| 3,466,982 | 9/1969 | Sullivan | 83/492 |
| 3,540,357 | 11/1970 | Ward, Jr. | 493/365 |
| 3,587,374 | 6/1971 | Stewart et al. | 83/56 |
| 3,611,884 | 10/1971 | Hotendorf | 493/55 |
| 3,651,723 | 3/1972 | Gallagher et al. | 83/864 |
| 3,855,890 | 12/1974 | Lynch et al. | 83/331 |
| 3,882,765 | 5/1975 | Tokuno | 493/362 |
| 3,952,637 | 4/1976 | Lambert et al. | 493/30 |
| 3,985,066 | 10/1976 | Kern | 493/60 |
| 4,003,300 | 1/1977 | Grobman | 493/365 |
| 4,061,063 | 12/1977 | Brush | 83/55 |
| 4,090,433 | 5/1978 | Jardine et al. | 493/352 |
| 4,211,498 | 7/1980 | Shimizu et al. | 83/881 X |

(List continued on next page.)

*Primary Examiner*—Rihaldi I. Rada
*Assistant Examiner*—Charles Goodman
*Attorney, Agent, or Firm*—Hovey, Williams, Timmons & Collins

[57] ABSTRACT

An improved scoring apparatus of the type used in box making operations for the purpose of creating strategically located scores and cuts in box blanks that define the folding lines and tabs of the finished boxes. The scoring apparatus includes a selectively retractable scoring blade that can be pivoted between an extended position and a retracted position during operation of the scoring apparatus for permitting scoring and cutting along any position of the box blanks.

31 Claims, 3 Drawing Sheets

U.S. PATENT DOCUMENTS

| | | | |
|---|---|---|---|
| 4,515,052 | 5/1985 | Flaum | 83/479 |
| 4,712,461 | 12/1987 | Rasmussen | 83/334 |
| 4,725,261 | 2/1988 | Millard et al. | 493/82 |
| 4,742,741 | 5/1988 | Hallberg et al. | 83/37 |
| 4,767,393 | 8/1988 | Smith | 493/342 |
| 4,781,668 | 11/1988 | Mowry | 493/365 |
| 4,805,502 | 2/1989 | Ishigure | 83/332 |
| 5,297,462 | 3/1994 | Creaden | 83/305 |
| 5,327,804 | 7/1994 | Creaden | 83/305 |
| 5,749,277 | 5/1998 | Walker | 83/568 X |

10
12
14
16
18
20
22
24
26
28
30
34
38
40
44
46
48
50
52
54
56
58
60
62
64
68
70
72
74
78
80
86
11
3.

ROTARY SCORING APPARATUS HAVING RETRACTABLE SCORING BLADE

This Application claims benefit from the Provisional patent application Ser. No. 60/033,754, filed Mar. 7, 1996, and entitled ROTARY SCORING APPARATUS HAVING RETRACTABLE SCORING BLADE, the teachings of which are incorporated herein by reference.

BACKGROUND OF THE INVENTION

1. Field of the Invention

The present invention relates to an improved scoring apparatus of the type used in box making operations for the purpose of creating strategically located scores and cuts in box blanks that define the folding lines and tabs of the finished boxes. More particularly, the invention relates to an improved scoring apparatus having a selectively retractable scoring blade that can be pivoted between an extended position and a retracted position during operation of the scoring apparatus for permitting scoring and cutting along any position of the box blanks.

2. Description of the Prior Art

Conventional box making operations generally involve the steps of cutting a box blank from a sheet of corrugated paperboard, scoring, cutting and/or slotting the box blank at strategic locations to form the fold lines, flaps, and tabs of the finished box, and folding the box blank along the fold lines to form a finished box.

The scoring, cutting and slotting operations are typically performed in scoring and cutting apparatuses having adjacent, serially aligned scoring and cutting cylinders or wheels rotatably mounted on powered drive shafts. Scoring blades and cutting blades are fixed to the rotating scoring and cutting cylinders for making scores and cuts in the box blanks as the box blanks are fed through the rotating scoring and cutting cylinders. Since the scoring blades and cutting blades rotate with the cutting cylinders, they score, cut and/or slot the blanks during each revolution of the cutting cylinders to create a series of spaced score lines and cuts used to form the fold lines, panels and flaps of a finished box.

The scoring and cutting apparatuses of the type described above suffer from several limitations that limit their utility. For example, the cutting blades and scoring blades on prior art scoring and cutting apparatuses are typically fixed to their respective rotating cylinders. Thus, a slot or score line is made in the box blanks each and every time the rotating cylinder completes a revolution. This limits the size of boxes that can be formed using the scoring and cutting apparatus because the maximum box blank length which can be handled is determined by the diameter of the rotating cutting cylinder. If it is desired to produce boxes that require greater spaces between the score lines and/or cuts, a larger, more expensive rotating cylinder must be provided.

Slotter wheel devices with adjustable slotter blades are known in the art. For example, U.S. Pat. No. 4,805,502 describes a slotter wheel device including a wheel-supporting shaft having an eccentric axis permitting selective movement of the supported slotting blades to a non-cutting position. However, to shift the slotting blades to the non-cutting position, it is necessary to stop the operation of the wheel, manipulate the eccentric axis to alter the blade position, and then resume slotting operations. Thus, the '502 device is incapable of positioning a slotting blade between a cutting position and an idle, blank-clearing position during rotation of the slotting wheel and cannot accommodate oversized box blanks.

U.S. Pat. Nos. 5,297,462 and 5,327,804, hereby incorporated by reference, disclose slotter wheel mechanisms having dynamically retractable slotter blades that allow the formation of boxes of various sizes. These patents provide greatly improved box making operations which allow the "skipping" of cutting during one or more successive slotter wheel revolutions. With this configuration, blanks of virtually any size may be readily slotted without stopping the slotter wheel device and without the need for employing larger diameter slotter wheels.

Although the '462 and '804 patents provide selectively retractable slotter blades, their scoring blades remain fixed. Therefore, although these devices can make slots anywhere along the length of the box blanks, they can place score lines for folding the boxes only at fixed locations.

Accordingly, there is a need for an improved rotary scoring apparatus that permits selective positioning of the scoring blades during rotation of the scoring cylinder so that blanks of virtually any length can be formed with standard sized scoring machines. There is also a need for an improved scoring apparatus that performs the above-described features yet is relatively simple and inexpensive to construct.

SUMMARY OF THE INVENTION

The present invention overcomes the problems outlined above and provides a greatly improved scoring apparatus for box making operations. Particularly, the scoring apparatus of the present invention includes a selectively retractable scoring blade that can be pivoted between an extended position and a retracted position during operation of the scoring apparatus for permitting scoring along any position of the box blanks. This allows selective control of the scoring and cutting operations during operation of the apparatus so that blanks of virtually any size can be scored and formed on a single scoring apparatus without the need to stop the rotating cylinder to readjust the scoring blades.

The preferred scoring apparatus broadly includes an elongated rotatable cylinder presenting an axial length and a peripheral margin, an elongated slot formed along the peripheral margin of the cylinder and extending across the length of the cylinder, drive means for rotating the cylinder, a scoring blade presenting an elongated scoring edge, coupling means for operably coupling the scoring blade in the slot, and scoring blade shifting structure operably coupled with the coupling means for selectively pivoting the scoring blade during rotation of the cylinder between an extended scoring position and a retracted, non-scoring position. When the scoring blade is pivoted to its extended scoring position, its scoring edge is located outboard of the cylinder peripheral margin for scoring the box blanks. Conversely, when the scoring blade is pivoted to its retracted, blank-clearing position, its scoring edge is located inboard of the cylinder peripheral margin for passing the box blanks without cutting the box blanks.

In preferred forms, the coupling means includes an elongated cylindrical blade shaft pivotally mounted within the elongated slot of the cylinder. The scoring blade is coupled with the shaft so that when the shaft is pivoted in one direction within the slot, the scoring edge is pivoted out of the slot, and when the shaft is pivoted in an opposite direction within the slot, the scoring edge is pivoted back into the slot.

The scoring blade shifting structure preferably includes a toggle arm operably coupled with one end of the blade shaft for pivoting the shaft and the blade between their extended and retracted positions during rotation of the cylinder, an actuating assembly for actuating or toggling the toggle arm between toggled and untoggled positions, and a spring assembly for alternately biasing the toggle arm towards its toggled and untoggled positions. When in the toggled position, the toggling arm pivots the shaft and the blade to their extended positions for exposing the blade cutting edge of the scoring blade. Conversely, when in the untoggled position, the toggling assembly pivots the shaft and the blade to their retracted positions for retracting the blade cutting edge into the elongated slot of the cylinder.

By constructing a scoring apparatus as described above, numerous advantages are realized. For example, by constructing a scoring apparatus having selectively retractable scoring blades, box blanks of nearly any length can be scored, and the scores can be placed anywhere along the length of the box blanks without employing a plurality of different sized cylinder and without stopping the rotation of the cylinder for adjusting the position of the score blades.

Additionally, by coupling the scoring blade to an elongated cylindrical blade shaft that is pivotally mounted within the slot of the cylinder, the scoring blade can be selectively extended or retracted by merely pivoting the shaft within the slot. This construction is simple yet effective.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Embodiments of FIGS. 1–10

Figures 1, 2, 3:
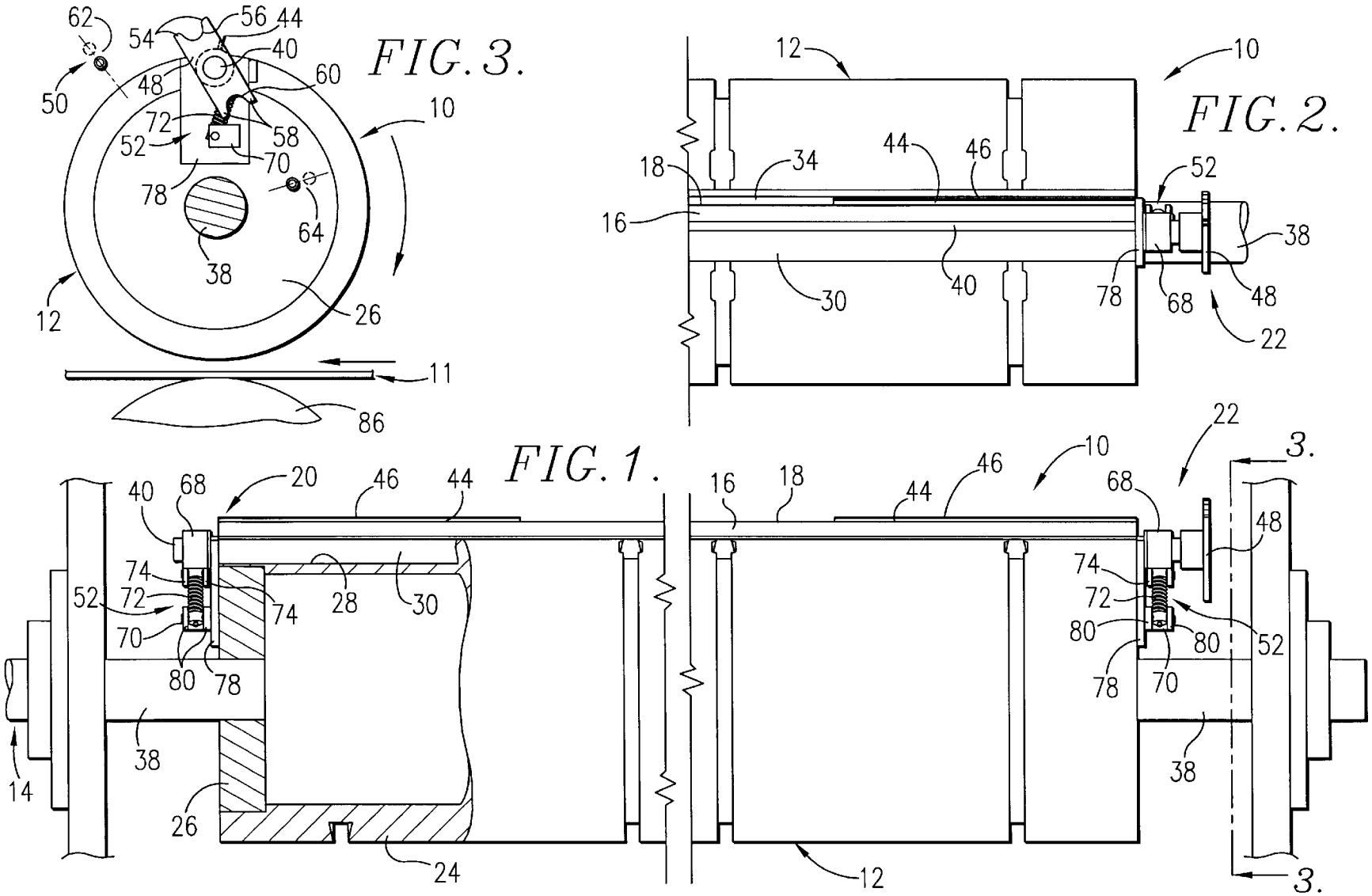
FIG. 1 is a front, fragmented, elevational view of a scoring apparatus constructed in accordance with a preferred embodiment of the invention with parts broken away.
FIG. 2 is a fragmented top plan view of the scoring apparatus.
FIG. 3 is a sectional view of the scoring apparatus taken along line 3—3 of FIG. 1 illustrating the scoring apparatus operating on a box blank.

Turning now to the drawing figures, and particularly FIG. 1, a rotary scoring apparatus 10 constructed in accordance with a first preferred embodiment of the invention is illustrated. The scoring apparatus 10 is operable for creating strategically located transversely extending score lines 13,15 in box blanks 11 such as those illustrated in FIGS. 9 and 10.

Returning to FIG. 1, the preferred scoring apparatus 10 broadly includes an elongated rotatable cylinder 12, drive means generally referred to by the numeral 14 for rotating the cylinder 12, an elongated scoring blade 16 presenting an elongated scoring edge 18, blade coupling means generally referred to by the numeral 20 for operably coupling the scoring blade 16 with the cylinder 12, and scoring blade shifting structure generally referred to by the numeral 22 for selectively pivoting the scoring blade 16 during rotation of the cylinder 12 between extended and retracted positions. As described in more detail below, when the scoring blade 16 is pivoted to its extended position, its scoring edge 18 is located outboard of the peripheral margin of the cylinder 12 for scoring box blanks passing thereunder. Conversely, when the scoring blade 16 is pivoted to its retracted position, its scoring edge 18 is located inboard of the peripheral margin of the cylinder 12 for permitting boxes to pass thereunder without being scored.

In more detail, the cylinder 12 includes an outer cylindrical sidewall 24 presenting an outer peripheral margin and a pair of circular endwalls 26 capping or closing the axial ends of the sidewall 24. The cylinder 12 is generally hollow along its axial length and is preferably formed of metallic materials. The cylinder 12 can be formed in various lengths and diameters for forming boxes of various sizes.

Figure 6:
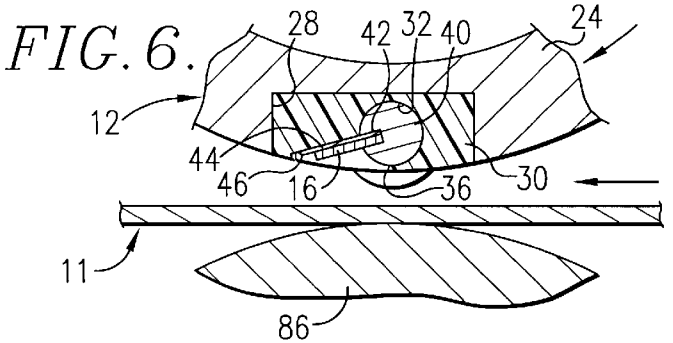
FIG. 6 is a fragmented sectional view of the scoring apparatus showing the scoring blade and blade coupling structure in the retracted, blank-clearing position.
Figure 7:
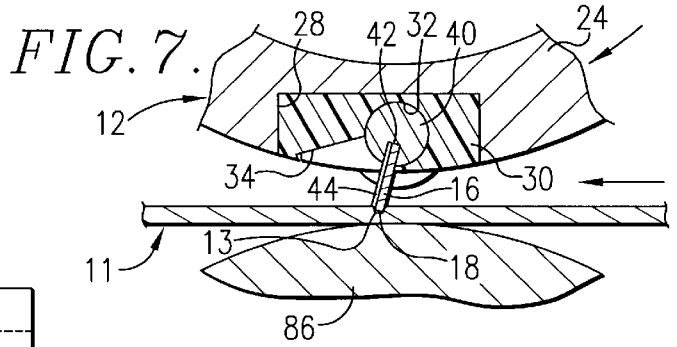
FIG. 7 is a fragmented sectional view of the scoring apparatus showing the scoring blade and blade coupling structure in the extended, scoring position.
Figure 8:
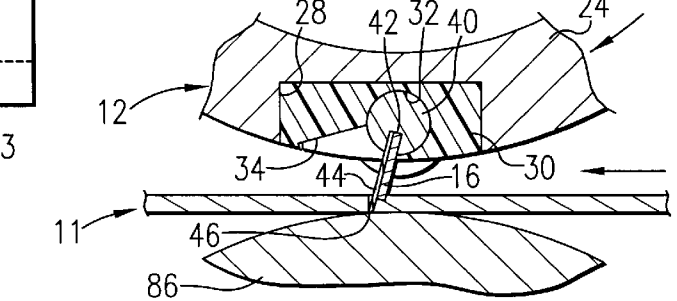
FIG. 8 is a fragmented sectional view of the apparatus showing a cutting blade coupled with the scoring blade in the extended, scoring position.

As best illustrated in FIGS. 6–8, the cylinder 12 includes an elongated slot 28 extending across its axial length and along its outer peripheral margin. The slot 28 is preferably generally rectangular in cross section.

An insert 30 is attached within the slot 28 and preferably extends along the entire length of the slot 28. The insert 30 is preferably formed of synthetic resin materials such as nylon and includes an elongated, cylindrical, open socket 32 extending across the length thereof. The socket 32 opens towards the peripheral margin of the cylinder 12 and includes a first shoulder region 34 (see FIG. 7) extending outwardly at an angle from the socket 32 towards the peripheral margin of the cylinder 12 and a second shoulder region 36 (see FIG. 6) extending generally transversely from the longitudinal axis of the cylinder towards the peripheral margin of the cylinder 12.

Returning to FIG. 1, the drive means 14 includes a conventional rotatable drive shaft 38 extending through the center of the endwalls 26. The drive shaft 38 is rotated by a conventional drive motor (not shown).

The scoring blade 16 is conventional in construction and presents a blunt or dulled scoring edge 18. The scoring blade 16 preferably extends across the length of the cylinder 12 but may also be formed in various other lengths for making score lines in various sized boxes.

As best illustrated in FIGS. 6–8, the blade coupling means 20 includes an elongated, cylindrical rotating member, preferably a blade shaft 40 pivotally positioned within the elongated socket 32. As illustrated in FIG. 1, the ends of the shaft 40 extend slightly beyond the endwalls 26 of the cylinder 12. The shaft 40 is preferably metallic and includes an elongated blade-receiving slot 42 extending along its length.

The non-scoring edge of the scoring blade 16 is secured in the blade-receiving slot 42 of the shaft 40 so that the scoring edge 18 extends radially from the shaft 40. Thus, the scoring blade 16 is operably coupled with the shaft 40 so that when the shaft 40 pivots within the socket 32 of the insert 30, the scoring blade 16 pivots into and out of the slot 28 formed in the peripheral margin of the cylinder 12.

Particularly, when the blade shaft 40 is rotated in a clockwise direction as viewed from FIG. 6, the scoring blade 16 is pivoted to a retracted, non-scoring position wherein it rests against the first shoulder portion 34 and its scoring edge 18 is located inboard of the cylinder 12 peripheral margin. This permits box blanks to pass the rotating cylinder 12 without being cut. Conversely, when the blade shaft 40 is rotated in a counterclockwise direction as viewed from FIGS. 7 and 8, the scoring blade 16 is pivoted to its extended scoring position wherein it rests against the second shoulder portion 36 and its scoring edge 18 is located outboard of the cylinder 12 peripheral margin for scoring the box blanks.

The preferred scoring apparatus 10 may also include one or more cutting blades 44 each presenting a cutting edge 46. The cutting blades 44 are positioned adjacent the scoring blade 16 in the blade-receiving slot 42 of the blade shaft 40. In preferred forms, two cutting blades 44 are positioned at opposite ends of the blade shaft 40 for cutting the end flaps of box blanks passing under the cylinder 12 as illustrated in FIG. 1. The scoring and cutting blades 16,44 can be of various lengths for making score lines or cuts in various sized boxes and may be moved along the axial length of the blade shaft 40 for making cuts at any position on the box blanks.

The blade shifting structure 22 is operably coupled with the blade shaft 40 for pivoting the blade shaft 40 and scoring blade 16 during rotation of the cylinder 12 between their extended, scoring position illustrated in FIGS. 7 and 8 and their retracted, non-scoring position illustrated in FIG. 6. As best illustrated in FIG. 3, the preferred blade shifting structure 22 includes a toggle arm 48 operably coupled with one end of the blade shaft 40 for pivoting the shaft 40 and the blade 16 between their extended and retracted positions during rotation of the cylinder 12, an activating intermittent assembly generally referred to by the numeral 50 for actuating or toggling the toggle arm 48 between toggled and untoggled positions, and a spring assembly generally referred to by the numeral 52 for alternately biasing the toggle arm 48 between its toggled and untoggled positions. The actuating assembly 50 is intermittent in that it repeatedly contacts the toggle arm 48 for brief moments as the toggle arm rotates with the cylinder.

The toggle arm 48 is secured to one end of the blade shaft 40 for pivotal movement therewith. The toggle arm 48 includes an outwardly extending arm 54 presenting a generally U-shaped recessed region 56 and an inwardly extending arm 58 presenting a similar U-shaped recessed region 60.

Figure 4:
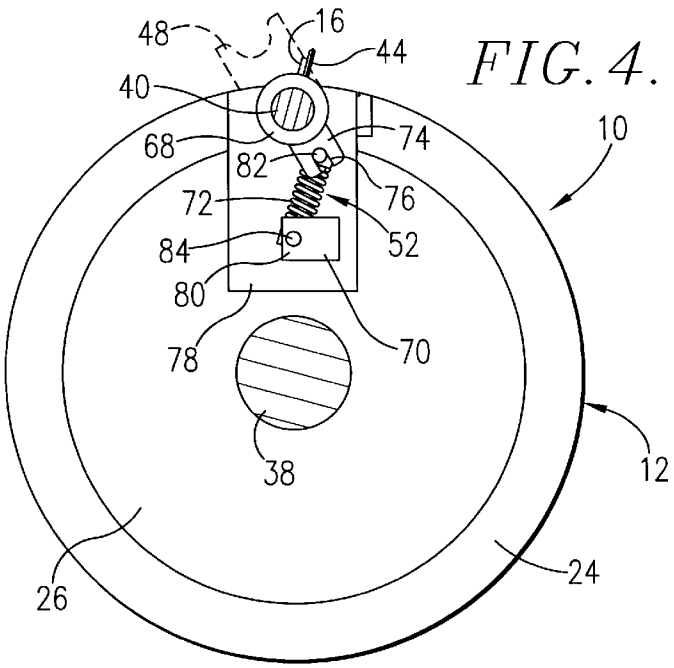
FIG. 4 is an end elevational view of the scoring apparatus showing the scoring blade in its extended, scoring position.
Figure 5:
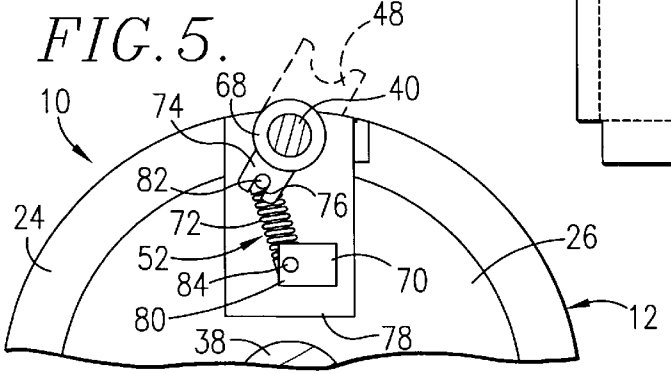
FIG. 5 is a fragmented end elevational view of the scoring apparatus showing the scoring blade in its retracted, blank-clearing position.

The toggle arm 48 is selectively shiftable between toggled and untoggled positions. When in the toggled position, the toggle arm 48 pivots the blade shaft 40 and the scoring blade 16 to their extended, scoring positions for exposing the scoring edge 18 of the scoring blade 16 as depicted in FIG. 4. Conversely, when in the untoggled position, the toggle arm 48 pivots the blade shaft 40 and the blade 16 to their retracted positions for retracting the scoring edge 18 of the scoring blade 16 as depicted in FIG. 5.

The actuating assembly 50 shifts the toggle arm 48 during rotation of the scoring cylinder 12 between its toggled and untoggled positions. As illustrated in FIG. 3, the preferred actuating assembly 50 is positioned on the same end of the cylinder 12 as the toggle arm 48 and includes a pair of first and second actuating elements 62,64. The actuating elements 62,64 are preferably conventional shiftable rods or shafts fixed adjacent the cylinder 12.

The first actuating element 62 is positioned outboard of the peripheral margin of the cylinder 12 and is radially shiftable with respect to the cylinder 12 between an inner, toggle arm-engaging position depicted by the solid lines and an outer, non-engaging position depicted by the dashed lines. When the first actuating element 62 is shifted to its inner position, it engages the outwardly extending arm 54 of the toggle arm 48 for toggling the toggle arm 48 to its toggled position. As described above, this pivots the blade shaft 40 and scoring blade 16 to their extended, cutting positions. Conversely, when the first actuating element 62 is shifted to its outer position, it allows the toggle arm 48 to pass by without being toggled.

The second actuating element 64 is positioned inboard of the peripheral margin of the cylinder 12 and is radially shiftable with respect to the cylinder 12 between an outer, toggle arm-engaging position depicted by the dashed lines and an inner, non-engaging position depicted by the solid lines. When the second actuating element 64 is shifted to its outer position, it engages the inwardly extending arm 58 of the toggle arm 48 for toggling the toggle arm 48 to its untoggled position. As described above, this pivots the blade shaft 40 and scoring blade 16 to their retracted, blank-clearing positions. Conversely, when the second actuating element 64 is shifted to its inner position, it allows the toggle arm 48 to pass by without being toggled.

The first and second actuating elements 62,64 can be shifted between their inner and outer positions by any conventional shifting device such as a retractable cylinder. In preferred forms, the shifting of the actuating elements 62,64 is controlled by a programmable controller device such as a PLC or computer for providing automatic control of the placement of the scoring blade 16 during rotation of the cylinder 12 for accurately controlling the placement of the score lines and cuts on the box blanks.

The spring assembly 52 is operably coupled with the toggle arm 48 for alternately biasing the toggle arm 48 to its toggled and untoggled positions after being shifted to these positions by the actuating assembly 50. In preferred forms, the scoring apparatus 10 includes a pair of identical spring assemblies operably coupled with opposite ends of the blade shaft 40.

As best illustrated in FIG. 4, each spring assembly 52 includes a collar 68, a spring mount 70, and a coiled compression spring 72. The collars 68 are attached to opposite ends of the blade shaft 40 for pivotal movement therewith. As illustrated in FIGS. 1 and 5, each collar 68 includes a pair of inwardly extending ear sections 74 each presenting a generally U-shaped recessed portion 76.

The spring mounts 70 are each positioned inboard of their respective collars 68 and are secured to support plates 78 mounted to the endwalls 26 of the cylinder 12. As best illustrated in FIG. 1, the spring mounts 70 each include a pair of spaced-apart arms 80. The arms 80 include a pair of aligned pin-receiving slots for receiving a retaining pin therein.

The compression springs 72 are conventional in construction and are coupled between their respective collars 68 and spring mounts 70. Specifically, as best illustrated in FIG. 5, one end of each compression spring 72 is coupled to its respective collar 68 by a retaining pin 82 coupled in the U-shaped recessed portions 76 of the collar's ear sections 74. The other end of the compression spring 72 is coupled to its respective spring mount 70 by a retaining pin 84 inserted through the pin-receiving holes of the spring mount 70.

The spring assembly 52 acts as an over-center biasing mechanism that alternately biases the blade shaft 40 and scoring blade 16 between their extended, scoring positions depicted in FIG. 4 and their retracted, blank-clearing positions depicted in FIG. 5. Specifically, once the toggle arm 48 has been toggled to either the toggled or untoggled position, the ear sections 74 of the collars 68 are positioned over the center point of their travel. The compression spring 72 exerts an outward or compressive force on the collar 68 that prevents it from pivoting until the toggle arm 48 is acted on by the actuating assembly 50. This prevents the scoring blade 16 from inadvertently shifting during operation of the cylinder 12 so that it remains in the desired position until shifted by the actuating assembly 50.

As illustrated in FIGS. 6–8, the scoring apparatus 10 also includes a lowermost anvil wheel 86, which is cooperatively positioned relative to the rotating cylinder 12 to present a blank receiving region therebetween. The anvil wheel 86 moves the box blanks along a path of travel underneath the rotating cylinder 12 and supports the box blanks during cutting and scoring operations.

Operation

Figure 9:
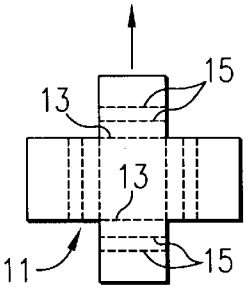
FIG. 9 is a plan view of a book-type box blank illustrating the placement of score lines along the length of the box.
Figure 10:
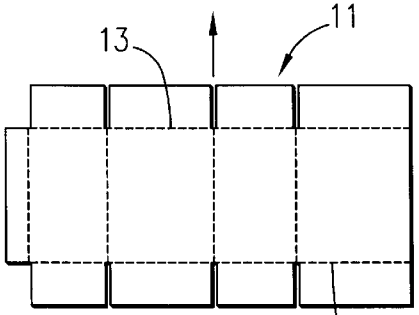
FIG. 10 is a plan view of traditional-type box blank illustrating the placement of score lines along the length of the box.

In operation, the scoring apparatus 10 described herein makes score lines and end cuts on box blanks similar to those illustrated in FIGS. 9 and 10 at selectively variable locations along the blanks without stopping the rotation of the cylinder 12. For example, if it is desired to make a score line or cut on every other revolution of the cylinder 12, the first actuating element 62 is shifted to its inner position as indicated in FIG. 3. This causes the first actuating element 62 to contact the outwardly extending ear sections 54 on the pivot arm 48 as the pivot arm 48 rotates past the first actuating element 62, thus pivoting the pivot arm 48, blade shaft 40, and scoring blade 16 to their extended, scoring positions as depicted in FIGS. 4, 7 and 8.

Then, after the scoring blade 16 makes a score on the box blank, the first and second actuating elements 62,64 are both shifted to their outermost positions as indicated by the dashed lines in FIG. 3. This causes the second actuating element 64 to contact the inwardly extending ear sections 58 of the pivot arm 48 as the pivot arm 48 rotates past the second rotating element 64 thus pivoting the pivot arm 48, blade shaft 40, and scoring blade 16 to their retracted positions as depicted in FIGS. 5 and 6. Since the cutting blade 44 and scoring blades 16 are retracted, no cuts or score lines are formed in the box blanks as they pass under the score cylinder 12. Subsequently, the first and second actuating elements 62,64 can be reshifted to their innermost positions for repivoting the blade shaft 40 and scoring blade 16 to their retracted positions.

Embodiments of FIGS. 11–17

In a second preferred embodiment of the invention, the scoring apparatus 10 also includes a second elongated scoring blade 88, blade mounting structure and coupling means generally referred to by the numeral 92 for operably coupling the second scoring blade 88 with the cylinder 12, and scoring blade shifting structure generally referred to by the numeral 94 for selectively pivoting the second scoring blade 88 during rotation of the cylinder 12 between extended and retracted positions. When the second scoring blade 88 is pivoted away from the center of the cylinder into the extended position, its scoring edge extends outwardly from the peripheral margin of the cylinder 12 for scoring box blanks passing thereunder. Conversely, when the second scoring blade 88 is pivoted towards the center of the cylinder into the retracted position, its scoring edge is nearly flush with the peripheral margin of the cylinder 12 for permitting boxes to pass thereunder without being scored.

In more detail, the second scoring blade 88 preferably consists of an elongated piano-type hinge assembly extending across the length of the cylinder along the peripheral margin of the cylinder 12. The hinge assembly includes a first hinge arm 96 fixed to the peripheral margin of the cylinder 12 and a second hinge arm 98 pivotally attached to the first hinge arm 96 by an elongated rotating member preferably a hinge pin 100.

The first hinge arm 96 includes a plurality of longitudinally spaced, threaded bolt holes for receiving bolts 102 as described in more detail below. The second hinge arm 98 presents a dull or blunted scoring edge 90 and pivots relative to the first hinge arm 96 between extended and retracted positions. An elongated stop 130 formed of rubber or other suitable material is positioned adjacent the second hinge arm 98 for limiting the travel of the second hinge arm when it is in its extended position.

In the second embodiment of the invention, the cylinder 12 includes a plurality of axially-spaced slots or grooves 104 extending around the peripheral margin of the cylinder 12. Each groove 104 extends around the circumference of the cylinder and presents a generally dovetail-shaped cross section (see FIG. 15) and a series of circumferentially-spaced enlarged openings 106 (see FIG. 12).

The blade coupling means 92 includes a plurality of inserts 107 that are inserted in the axially-spaced grooves 104 of the cylinder. The inserts 107 are preferably formed of synthetic resin materials such as nylon and present a generally dovetail-shaped cross section. The inserts 107 are inserted in the enlarged openings 106 of the dove-tail grooves 104 and can be moved in the grooves 104 to different locations along the peripheral margin of the cylinder 12 so that the second blade is circumferentially shiftable.

Figures 11, 12, 13, 14, 15, 16, 17:
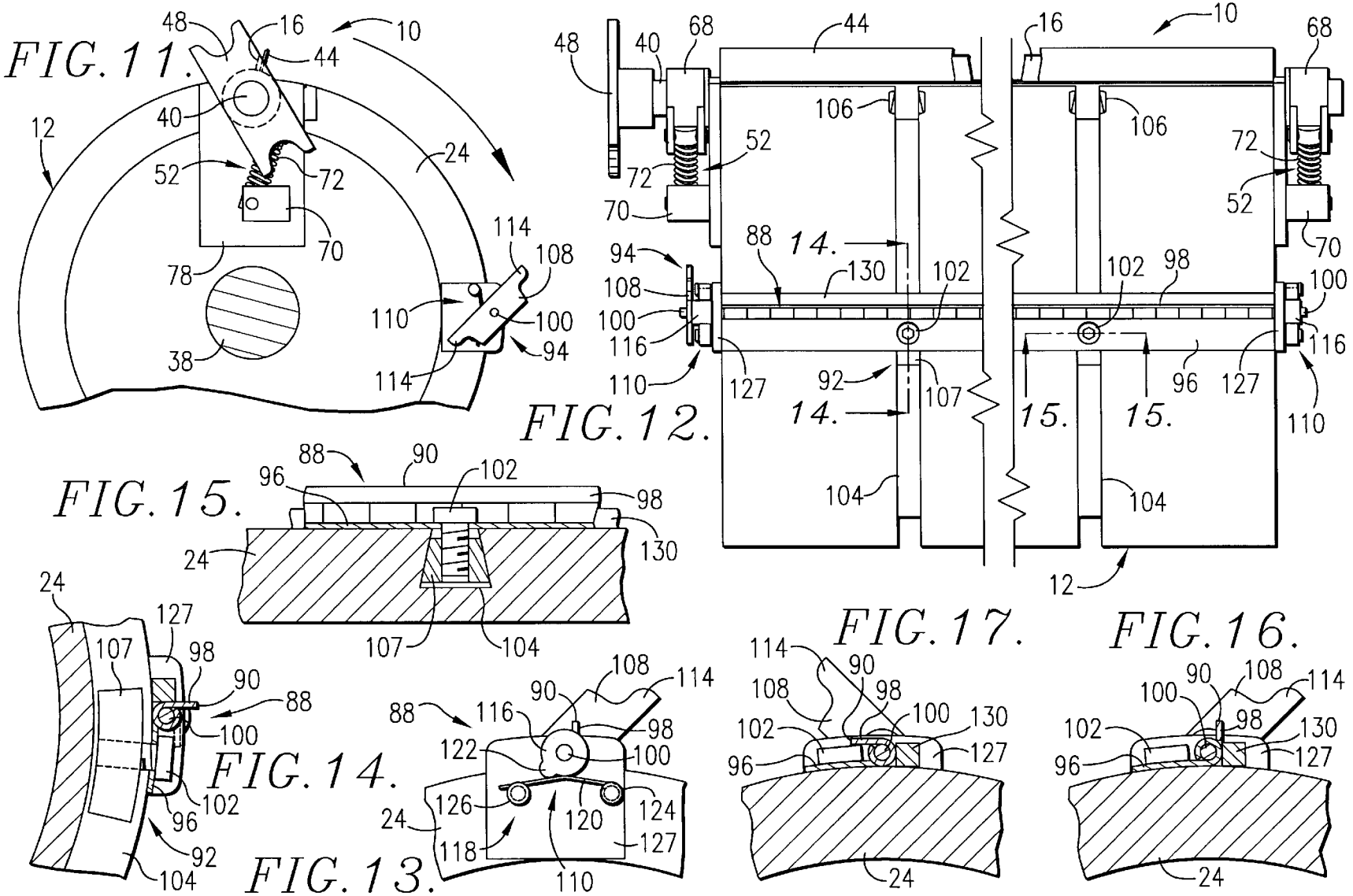
FIG. 11 is a fragmented end elevational view of a scoring apparatus constructed in accordance with a second preferred embodiment of the invention.
FIG. 12 is a fragmented, front elevational view of the scoring apparatus illustrated in FIG. 11 with parts broken away.
FIG. 13 is a fragmented end view of the scoring apparatus of FIG. 11 illustrating the second scoring blade in its extended, scoring position.
FIG. 14 is a fragmented sectional view of the scoring apparatus taken along line 14—14 of FIG. 11 illustrating the second scoring blade in its extended, scoring position.
FIG. 15 is a fragmented sectional view of the scoring apparatus taken along line 15—15 of FIG. 11.
FIG. 16 is a fragmented sectional view of the scoring apparatus illustrating the second scoring blade in its extended, scoring position.
FIG. 17 is a fragmented sectional view of the scoring apparatus illustrating the second scoring blade in its retracted, blank-clearing position.

Once the inserts 107 are positioned at their desired locations in the grooves 104, the bolts 102 are threaded through the bolt holes on the first hinge arm 96 and into the inserts for securing the second scoring blade 88 to the peripheral margin of the cylinder 12 as depicted in FIG. 15. The second scoring blade 88 can be moved anywhere along the peripheral margin of the cylinder 12 by loosening the bolts 102 and repositioning the inserts 107 within the grooves 104. The bolts 102 can then be re-tightened for re-securing the second scoring blade 88 to the cylinder 12.

The scoring blade shifting structure 94 for the second scoring blade 88 includes a toggle arm 108 operably coupled with one end of the hinge pin 100 for pivoting the hinge pin 100 and the second hinge arm 98 between their extended and retracted positions during rotation of the cylinder 12 and a spring assembly 110 for alternately biasing the toggle arm 108 towards its toggled and un-toggled positions.

As best illustrated in FIG. 11, the toggle arm is secured to one end of the hinge pin 100 for pivotal movement therewith and includes a pair of outwardly extending legs 114. The toggle arm 108 is selectively shiftable between toggled and untoggled positions. When in the toggled position, the toggle arm 108 pivots the hinge pin 100 and the second hinge arm 98 to their extended, scoring positions for exposing the scoring edge 90 of the scoring blade 88 as depicted in FIGS. 14 and 16. Conversely, when in the untoggled position, the toggle arm 108 pivots the hinge pin 100 and the second hinge arm 98 to their retracted positions for retracting the scoring edge 90 as depicted in FIG. 17.

The toggle arm 108 is shifted between its toggled and un-toggled positions by the actuating assembly 50 described in the first embodiment of the invention above.

The spring assembly 110 is operably coupled with the toggle arm 108 and hinge pin 100 for alternately biasing the toggle arm 108 to its toggled and un-toggled positions after being shifted to these positions by the actuating assembly 50. In preferred forms, the scoring apparatus 10 includes a pair of spring assemblies 110 operably coupled with opposite ends of the hinge pin 100.

As best illustrated in FIG. 13, each spring assembly 110 includes a collar 116, a spring mount 118, and a leaf spring 120. The collars 116 are attached to opposite ends of the hinge pin 100 for pivotal movement therewith and each includes an outwardly extending ear section 122.

The spring mounts 118 are positioned adjacent their respective collars 116 for operably coupling the leaf springs 120 with the collars 116. Each spring mount 118 preferably includes a pair of spaced-apart rivets 124,126 or bolts secured to a support plate 127 adjacent its respective collar 116.

Each leaf spring 120 is conventional in construction and presents a raised central apex region. One end of each leaf spring 120 is pivotally coupled with one of its rivets 124 and the other end extends over the other of its rivets 126 and freely slides thereover.

The spring assembly 110 acts as an over-center biasing mechanism that alternately biases the toggle arm 108, hinge pin 100 and second hinge arm 98 between their extended, scoring positions and their retracted, blank-clearing positions. Initially, the ear sections 122 of the collars 116 are positioned on one side of the apex of the springs 110. The leaf springs 120 provide a compressive or outward force on the collars 116 that prevent the collars 116 from rotating until the toggle arm 108 is acted on by the actuating assembly 50. When the actuating assembly 50 shifts the toggle arm 108 during rotation of the cylinder 12, the ear sections 122 shift over the apexes of the leaf springs 120. Thus, the spring assembly 110 biases the toggle arm 108 to its last position to prevent the second scoring blade 88 from inadvertently shifting during operation of the cylinder 12. This insures that the scoring blade 88 remains in the desired position until shifted by the actuating assembly 50.

The second scoring blade 88 may operate independently or in conjunction with the first scoring blade 16 described in the first embodiment of the invention for making score lines and end cuts on box blanks at selectively variable locations along the blanks without stopping the rotation of the cylinder 12.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by letters patent includes the following:

I claim:

1. A rotary scoring apparatus for scoring box blanks at spaced locations on the box blanks as the box blanks are sequentially advanced along a path of travel, said scoring apparatus comprising:

an elongated rotatable cylinder having a center and presenting an axial length and a peripheral margin;

drive means for rotating said cylinder;

a scoring blade presenting an elongated scoring edge;

blade mounting structure mounting the scoring blade on the cylinder;

scoring blade shifting structure operably coupled with said mounting structure selectively pivoting said scoring blade in and out of an extending scoring position during rotation of said cylinder between an extended scoring position wherein said scoring edge is pivoted away from said center of said cylinder for scoring the box blanks, and a retracted, blank-clearing position wherein said scoring edge is pivoted toward said center of said cylinder for passing the box blanks without scoring the box blanks, said blade shifting structure including an intermittent actuating assembly shifting said scoring blade in and out of the scoring position during rotation of the cylinder relative to the actuating assembly.

2. The rotary scoring apparatus as set forth in claim 1, wherein said blade mounting structure comprises a pivotal blade shaft, said shifting structure includes a shiftable arm operably coupled with said blade shaft for pivoting said blade shaft during rotation of said cylinder for pivoting said scoring blade between said extended and retracted positions, and at least one actuating member movable between a first arm-engaging position and a second arm-clearing position; said actuating member oriented in said first position for engaging said arm during rotation of said cylinder in order to shift the arm.

3. The rotary scoring apparatus as set forth in claim 1, wherein the blade mounting structure comprises an elongated slot formed in said peripheral margin.

4. The rotary scoring apparatus as set forth in claim 3, wherein said slot extends across said axial length of said cylinder.

5. The rotary scoring apparatus as set forth in claim 1, further comprising a spring assembly alternately biasing the blade in the extended and retracted positions.

6. The rotary scoring apparatus as set forth in claim 5, wherein the spring assembly comprises a leaf spring.

7. The rotary scoring apparatus as set forth in claim 5, wherein the spring assembly comprises a coil spring.

8. A rotary scoring apparatus for scoring box blanks at spaced locations on the box blanks as the box blanks are sequentially advanced along a path of travel, said scoring apparatus comprising:

an elongated rotatable cylinder presenting a pair of opposed end surfaces, an axially peripheral surface which is circular in cross-section and extends between said end surfaces, and an elongated, axially extending slot formed in said cylinder and intersecting said peripheral surface;

a scoring blade presenting an elongated scoring edge located within and extending along the length of said slot; and scoring blade shifting mechanism operably coupled with said blade to selectively shift the scoring blade relative to said cylinder and said peripheral surface during rotation of said cylinder, said blade shifting mechanism including an elongated, pivotal blade shaft located within said slot and supporting said blade, said blade being selectively pivotal between an extended scoring position wherein said scoring edge is shifted outboard of said cylinder peripheral surface for scoring the box blanks, and a retracted, blank-clearing position wherein said scoring edge is shifted inboard of said cylinder peripheral surface for passing the box blanks without scoring the box blanks, said mechanism operable to shift said blade between said positions during rotation of said cylinder and without stopping the rotation of the cylinder, said mechanism operable to retain said blade in said retracted position throughout a complete revolution of said cylinder.

9. The apparatus of claim 8, including a spring assembly for holding said blade in said extended and retracted positions respectively.

10. The apparatus of claim 8, said cylinder including a plurality of axially spaced grooves extending around said peripheral surface.

11. The apparatus of claim 10, further including a second scoring blade presenting an elongated scoring edge, and an adjustable coupling means for operably coupling said second scoring blade in said grooves and for adjusting the position of said second scoring blade along said peripheral surface of said cylinder.

12. The apparatus of claim 11, further including second scoring blade shifting structure for selectively pivoting said second scoring blade during rotation of said cylinder between an extended scoring position wherein said scoring edge of said second scoring blade is pivoted so that said scoring edge of said second scoring blade extends radially from said cylinder peripheral surface for scoring the box blanks, and a retracted, blank-clearing position wherein said scoring edge of said second scoring blade is pivoted so that said scoring edge of said second scoring blade is nearly flush with said cylinder peripheral surface for passing the box blanks without cutting the box blanks.

13. The apparatus of claim 12, said drive means including an elongated rotatable drive shaft for rotating said cylinder and a drive motor for rotating said drive shaft.

14. A rotary scoring apparatus for scoring box blanks at spaced locations on the box blanks as the box blanks are sequentially advanced along a path of travel, said scoring apparatus comprising:

an elongated rotatable cylinder presenting an axial length and a peripheral margin, said cylinder including an elongated slot formed in said peripheral margin;

a drive operable to rotate said cylinder;

a scoring blade presenting an elongated scoring edge;

coupling means for operably coupling said scoring blade in said elongated slot, said coupling means including an elongated cylindrical blade shaft pivotally mounted within said slot, said scoring blade attached to said shaft so that said scoring edge extends radially outwardly from said blade shaft;

scoring blade shifting structure operably coupled with said coupling means for selectively pivoting said scoring blade toward and away from said cylinder during rotation of said cylinder between an extended scoring position wherein said scoring edge is pivoted outboard of said cylinder peripheral margin for scoring the box blanks, and a retracted, blank-clearing position wherein said scoring edge is located closer to said cylinder for passing the box blanks without scoring the box blanks, said scoring blade shifting structure including a toggle arm operably coupled with one end of said blade shaft for pivoting said blade shaft during rotation of said cylinder for pivoting said scoring blade between said extended and retracted positions.

15. The rotary scoring apparatus as set forth in claim 1, said scoring blade shifting structure further including an actuating assembly for selectively shifting said toggle arm during rotation of said cylinder between a toggled position wherein said toggle arm pivots said blade shaft and said blade to said extended position and an untoggled position wherein said toggle arm pivots said blade shaft and said blade to said retracted position.

16. The rotary scoring apparatus as set forth in claim 15, said scoring blade shifting structure further including a spring assembly operably coupled with said toggle arm for alternately biasing said toggle arm to said toggled and untoggled positions.

17. The rotary scoring apparatus as set forth in claim 15, said actuating assembly including a first actuating element positioned outboard of said peripheral margin of said cylinder and a second actuating element positioned inboard of said peripheral margin of said cylinder.

18. The rotary scoring apparatus as set forth in claim 17, said toggle arm including an outwardly extending arm extending outboard of said peripheral margin of said cylinder for engaging said first actuating element during rotation of said cylinder and an inwardly extending arm extending inboard of said peripheral margin of said cylinder for engaging said second actuating element during rotation of said cylinder.

19. The rotary scoring apparatus as set forth in claim 1, said cylinder including a plurality of axially spaced grooves extending around said peripheral margin.

20. The rotary scoring apparatus as set forth in claim 19, further including a second scoring blade presenting an elongated scoring edge oriented substantially parallel to said axial length of said cylinder, and an adjustable coupling means for operably coupling said second scoring blade with said grooves and for adjusting the position of said second scoring blade along said peripheral margin of said cylinder.

21. The rotary scoring apparatus as set forth in claim 20, further including second scoring blade shifting structure for selectively pivoting said second scoring blade during rotation of said cylinder between an extended scoring position wherein said scoring edge of said second scoring blade is pivoted so that said scoring edge of said second scoring blade extends radially from said cylinder peripheral margin for scoring the box blanks, and a retracted, blank-clearing position wherein said scoring edge of said second scoring blade is pivoted so that said scoring edge of said second scoring blade is nearly flush with said cylinder peripheral margin for passing the box blanks without cutting the box blanks.

22. The rotary scoring apparatus as set forth in claim 1, said drive means including an elongated rotatable drive shaft for rotating said cylinder.

23. The rotary scoring apparatus as set forth in claim 14, wherein said retracted position comprises said scoring edge being located inboard of said cylinder peripheral margin for passing the box blanks without cutting the box blanks.

24. The rotary scoring apparatus as set forth in claim 14, wherein said slot extends across said axial length.

25. The rotary scoring apparatus as set forth in claim 14, wherein said scoring blade moves in and out of said elongated slot.

26. A rotary scoring apparatus for scoring box blanks at spaced locations on the box blanks as the box blanks are sequentially advanced along a path of travel, said scoring apparatus comprising:

an elongated rotatable cylinder presenting an axial length and a peripheral margin, said cylinder including an elongated slot formed in said peripheral margin and extending across said axial length;

drive means for rotating said cylinder;

a scoring blade presenting an elongated scoring edge;

coupling means for operably coupling said scoring blade in said elongated slot; and scoring blade shifting structure for selectively pivoting said scoring blade in and out of said elongated slot during rotation of said cylinder between an extended scoring position wherein said scoring edge is pivoted outboard of said cylinder peripheral margin for scoring the box blanks, and a retracted, blank-clearing position wherein said scoring edge is located inboard of said cylinder peripheral margin for passing the box blanks without scoring the box blanks, said coupling means including an elongated cylindrical blade shaft pivotally mounted within said slot, said scoring blade being fixedly coupled with said blade shaft so that said scoring edge extends radially outwardly from said shaft, said scoring blade shifting structure including a toggle arm operably coupled with one end of said blade shaft for pivoting said blade shaft during rotation of said cylinder for pivoting said scoring blade between said extended and retracted positions; and said scoring blade shifting structure further including an intermittent actuating assembly for shifting said toggle arm during rotation of said cylinder between a toggled position wherein said toggle arm pivots said blade shaft and said blade to said extended position and an un-toggled position wherein said toggle arm pivots said blade shaft and said blade to said retracted position.

27. The rotary scoring apparatus as set forth in claim 26, said scoring blade shifting structure further including a spring assembly operably coupled with said toggle arm for alternately biasing said toggle arm to said toggled and untoggled positions.

28. The rotary scoring apparatus as set forth in claim 26, said cylinder including a plurality of axially spaced grooves extending around said peripheral margin.

29. The rotary scoring apparatus as set forth in claim 28, further including a second scoring blade presenting an elongated scoring edge, and an adjustable coupling means for operably coupling said second scoring blade in said grooves and for adjusting the position of said second scoring blade along said peripheral margin of said cylinder.

30. The rotary scoring apparatus as set forth in claim 29, further including second scoring blade shifting structure for selectively pivoting said second scoring blade during rotation of said cylinder between an extended scoring position wherein said scoring edge of said second scoring blade is pivoted so that said scoring edge of said second scoring blade extends radially from said cylinder peripheral margin for scoring the box blanks, and a retracted, blank-clearing position wherein said scoring edge of said second scoring blade is pivoted so that said scoring edge of said second scoring blade is nearly flush with said cylinder peripheral margin for passing the box blanks without cutting the box blanks.

31. The rotary scoring apparatus as set forth in claim 30, said drive means including an elongated rotatable drive shaft for rotating said cylinder and a drive motor for rotating said drive shaft.

* * * * *